US008142203B2

(12) United States Patent
Chen

(10) Patent No.: US 8,142,203 B2
(45) Date of Patent: Mar. 27, 2012

(54) ELECTRICAL CONNECTOR WITH GROOVES RECEIVING CRUMBS

(75) Inventor: De-Jin Chen, Shenzhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 80 days.

(21) Appl. No.: 12/828,309

(22) Filed: Jul. 1, 2010

(65) Prior Publication Data

US 2011/0076890 A1 Mar. 31, 2011

(30) Foreign Application Priority Data

Sep. 29, 2009 (CN) ..... 200920311821

(51) Int. Cl.
*H01R 12/00* (2006.01)

(52) U.S. Cl. ..... 439/74; 439/733.1

(58) Field of Classification Search ..... 439/74, 439/733.1

See application file for complete search history.

(56) References Cited

U.S. PATENT DOCUMENTS

| | | | | |
|---|---|---|---|---|
| 5,873,753 | A * | 2/1999 | Norris et al. | 439/752 |
| 7,435,100 | B2 * | 10/2008 | Chang et al. | 439/66 |
| 7,588,441 | B2 * | 9/2009 | Chang et al. | 439/66 |
| 8,002,558 | B2 * | 8/2011 | Liao et al. | 439/74 |

* cited by examiner

*Primary Examiner* — Truc Nguyen

(74) *Attorney, Agent, or Firm* — Wei Te Chung; Andrew C. Cheng; Ming Chieh Chang

(57) ABSTRACT

An electrical connector includes an insulative housing and a plurality of contacts. The insulative housing defines a mating face, a mounting face opposite to the mating face and a plurality of receiving passageways running through the mating face and the mounting face. The contacts are assembled in the receiving passageways and each contact include a base portion, a pair of retaining portions extending from two opposite ends of the base portion, a pair of elastic arms extending from the retaining portions, a soldering portion extending out of the receiving passageways and a connecting portion connecting the soldering portion and the base portion. Each receiving passageway protrudes a tuber from a first inner face thereof. Free ends of the retaining portions are located at two sides of the tuber and engage with the first inner face of the receiving passageway. The tuber is spaced from the two retaining portions at two sides of the tuber. A pair of tabs defined at a free end of the tuber press against the pair of retaining portions to form a pair of receiving grooves between the two sides of the tuber and the retaining portions.

9 Claims, 4 Drawing Sheets

ELECTRICAL CONNECTOR WITH GROOVES RECEIVING CRUMBS

BACKGROUND OF THE INVENTION

1. Field of the Invention

The present invention relates to an electrical connector, and more particularly to an electrical connector with a plurality of grooves receiving crumbs which are caused by the engagement of contacts and an insulative housing.

2. Description of the Related Art

A traditional electrical connector comprises an insulative housing and a plurality of contacts received in the insulative housing. The insulative housing defines a plurality of receiving passageways. The contacts are received in the receiving passageway and each includes an elastic portion contacting with a mating connector, a retaining portion secured to the insulative housing and a soldering portion mounting on a PCB (Print Circuit Board). The retaining portion engages with the insulative housing to secure the contact in the insulative housing. The insulative housing is easy to be destroyed and causes crumbs. The crumbs in the receiving passageway would cause a bad connection between the electrical connector and the mating connector.

In view of the above, a new electrical connector that overcomes the above-mentioned disadvantages is desired.

SUMMARY OF THE INVENTION

Accordingly, an object of the present invention is to provide an electrical connector with a plurality of grooves receiving crumbs which are caused by the engagement of contacts and an insulative housing.

To fulfill the above-mentioned object, an electrical connector comprises an insulative housing and a plurality of contacts. The insulative housing defines a mating face, a mounting face opposite to the mating face and a plurality of receiving passageways running through the mating face and the mounting face. The contacts are assembled in the receiving passageways and each contact include a base portion, a pair of retaining portions extending from two opposite ends of the base portion, a pair of elastic arms extending from the retaining portions, a soldering portion extending out of the receiving passageways and a connecting portion connecting the soldering portion and the base portion. Each receiving passageway protrudes a tuber from a first inner face thereof. Free ends of the retaining portions are located at two sides of the tuber and engage with the first inner face of the receiving passageway. The tuber is spaced from the two retaining portions at two sides of the tuber. A pair of tabs defined at a free end of the tuber press against the pair of retaining portions to form a pair of receiving grooves between the two sides of the tuber and the retaining portions.

Other objects, advantages and novel features of the invention will become more apparent from the following detailed description when taken in conjunction with the accompanying drawings.

DETAILED DESCRIPTION OF THE PREFERRED EMBODIMENT OF THE INVENTION

Reference will now be made to the drawings to describe the present invention in detail.

Figure 1:
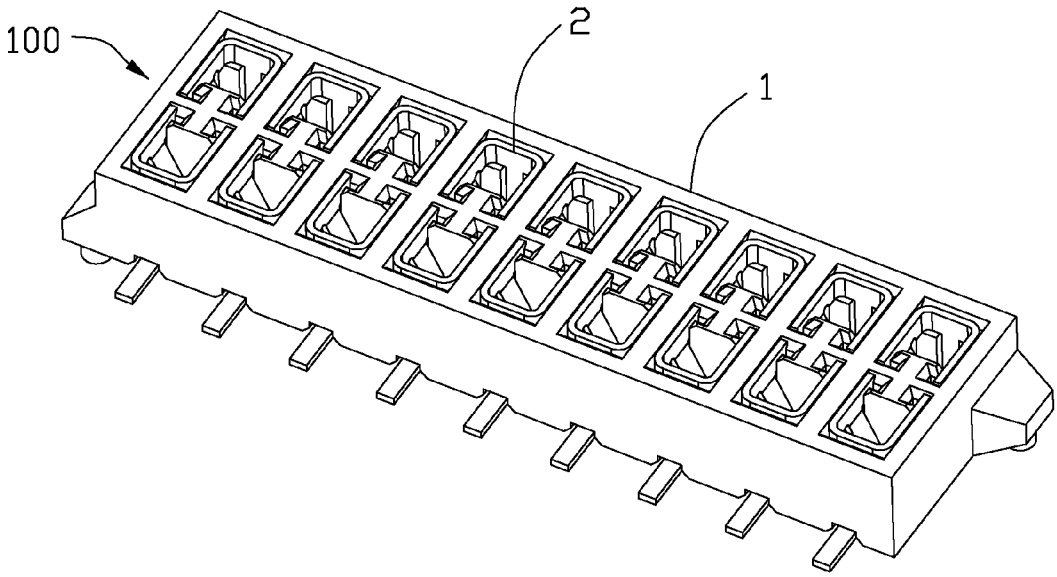
FIG. 1 is a perspective view of an electrical connector of the present invention.

Referring to FIG. 1, an electrical connector 100 includes a longitudinal insulative housing 1 and a plurality of contacts 2 assembled in the insulative housing 1.

Figure 2:
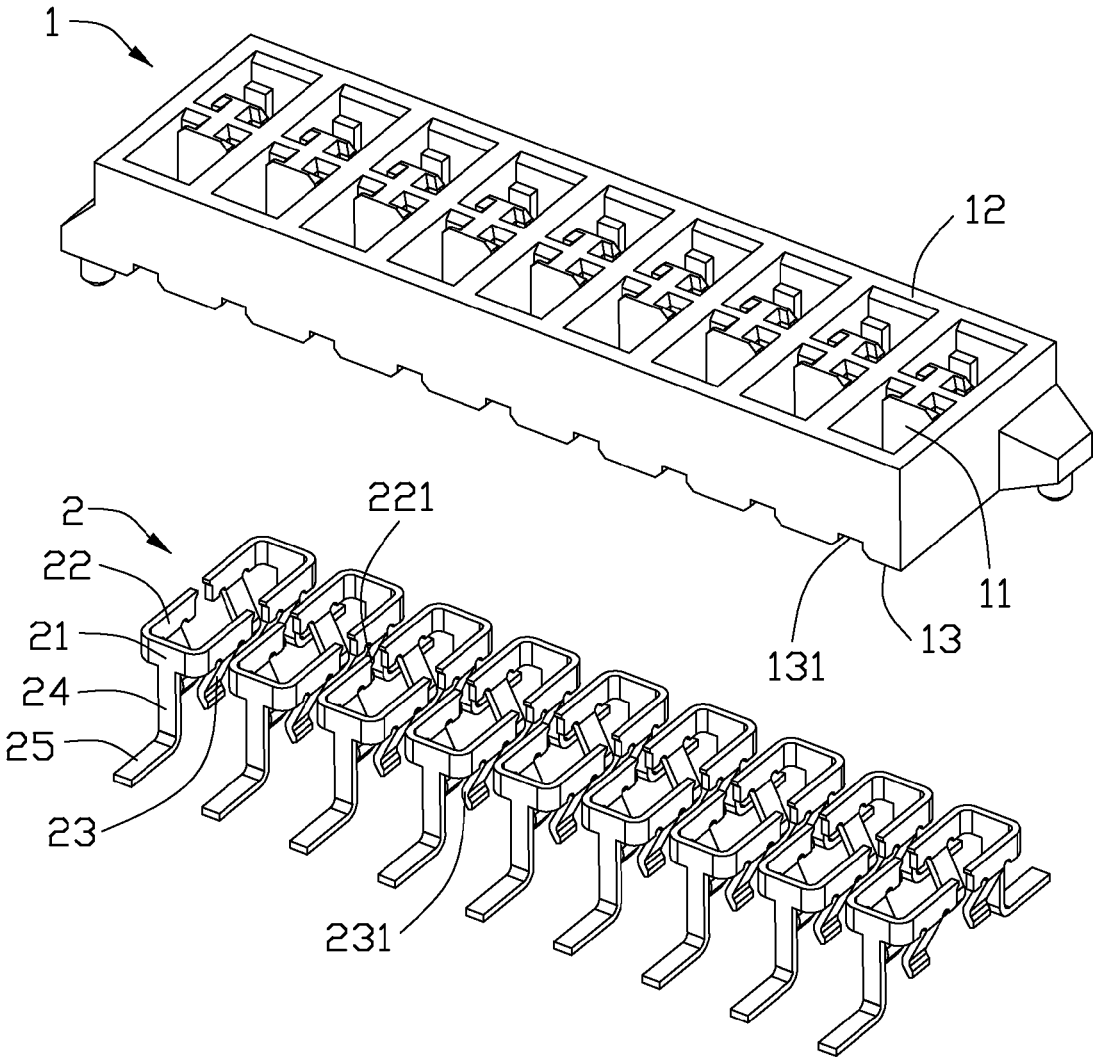
FIG. 2 is an exploded view of the electrical connector of FIG. 1.

Referring to FIG. 2, the insulative housing 1 defines a top mating face 12 for confronting with a mating connector (not shown), a bottom mounting face 13 opposite to the mating face for mounting on a PCB and a plurality of receiving passageways 11 running through the top face 12 and the bottom face 13. The receiving passageways 11 are arranged symmetrically in two rows.

Figure 3:
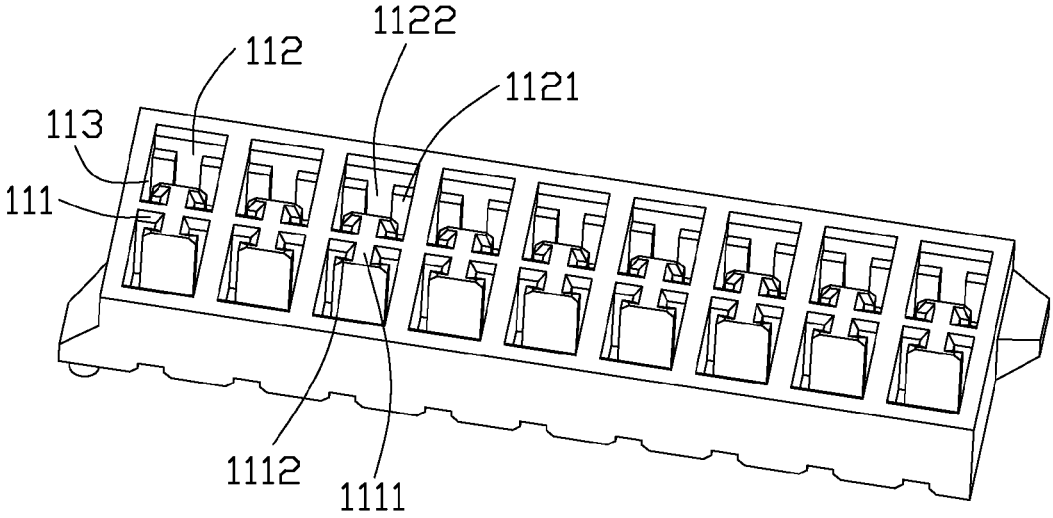
FIG. 3 is a perspective view of an insulative housing of the electrical connector of FIG. 1.

Each contact 2 defines a base portion 21, a pair of retaining portions 22 extending perpendicularly from two opposite ends of the base portion 21, a pair of elastic arms 23 extending downward from the two retaining portions 22, a soldering portion 25 mounting on the PCB and a vertical connecting portion 24 connecting the base portion 21 and the soldering portion 25. The retaining portions 22 are located adjacent to the mating face 12. The two elastic arms 23 define a pair of contacting point 231 facing to each other and electrically connecting with the mating connector. The bottom face 13 of the insulative housing 1 defines a plurality of cutouts 131 from which the soldering portion 25 extends out of the insulative housing 1. Referring to FIG. 3, each receiving passageway 11 defines a first inner face 111, a second inner face 112 opposite to the first inner face 111 and a pair of third inner faces 113 bridging the first inner face 111 and the second inner face 112. The second inner face 112 protrudes a pair of bosses 1121 on two sides close to the corresponding third inner faces 113 so as to form a T-shaped groove 1122. The base portion 21 and the connecting portion 24 resist on the second inner face 112 and are received in the T-shaped groove 1122. The soldering portion 25 extends vertically from the connecting portion 24. After the contact 2 is assembled in the insulative housing 1 from an up-to-down direction, the soldering portion 25 is folded perpendicular to the connecting portion 24.

Figure 4:
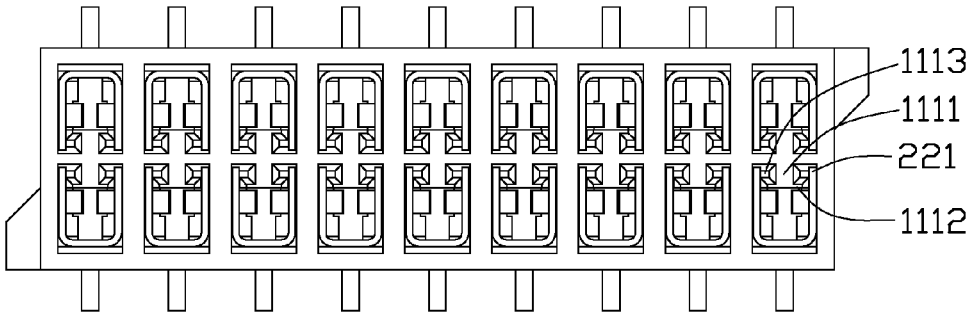
FIG. 4 is a top plan view of the electrical connector of FIG. 1.

The first inner face 111 of the receiving passageway 11 perpendicularly protrudes a tuber 1111 extending from the mating face 12 to the mounting face 13. The pair of retaining portions 22 of one contact 2 resist on two third inner faces 113 and free ends 221 of retaining portions 22 abut against the first inner face 111. Referring to FIG. 4, the tuber 1111 is spaced from the retaining portion 22 at two sides of the tuber 1111. A pair of tabs 1112 respectively projecting towards the two third inner faces 113 at a free end of the tuber 1111 is resisted on the two retaining portions 22. A pair of receiving grooves 1113 is configured between the two sides of the tuber 1111 and the retaining portions 22. The tuber 1111 and the tab 1112 are configured with a T-shaped manner. When the retaining portions 22 are inserted in the receiving passageways 11, the retaining portions 22 especially the free ends 221 thereof scrap the inner faces of the receiving passageways 11 and cause crumbs. The receiving grooves 1113 can accept the crumbs to prevent the crumbs from the receiving passageways 11.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

an insulative housing defining a mating face, a mounting face opposite to the mating face and a plurality of receiving passageways running through the mating face and the mounting face;

a plurality of contacts assembled in the receiving passageways and each contact including a base portion, a pair of retaining portions extending from two opposite ends of the base portion, a pair of elastic arms extending from the retaining portions, a soldering portion extending out of the receiving passageways and a connecting portion connecting the soldering portion and the base portion;

each receiving passageway protrudes a tuber from a first inner face thereof, free ends of the pair of retaining portions being located at two sides of the tuber and engaging with the first inner face of the receiving passageway;

wherein the tuber is spaced from the two retaining portions at two sides of the tuber, a pair of tabs defined at a free end of the tuber;

wherein the tuber and the tabs are configured with a T-shaped manner;

wherein the base portion and the connecting portion resist on a second inner face, opposite to the first inner face of the receiving passageway;

wherein the second inner face of the receiving passageway protrude a pair of bosses to form a T-shaped groove to receive the base portion and the connecting portion.

2. The electrical connector as claimed in claim 1, wherein the mounting face defines a plurality of cutouts through which the soldering portions extend out of the receiving passageways.

3. An electrical connector, comprising:

an insulative housing defines a mating face and a mounting face opposite to each other and a plurality of receiving passageways running through the mating face and the mounting face;

a plurality of contacts received and retained in the passageways, each contact comprising a frame retaining portion with two free ends thereof, a contacting portion projecting in the receiving passageway from the frame retaining portion and a soldering leg extending along the mounting face from the frame retaining portion;

the frame retaining portion interfering with inner faces of the receiving passageway by one side thereof except that the two free ends of the frame retaining portion interfering with the inner faces of the receiving passageway by two opposite sides thereof;

wherein said inner faces of the receiving passageway define a groove communicating with each corresponding free end of the retaining portion;

wherein each receiving passageway protrudes a tuber;

wherein the free ends of the pair of retaining portions being located at two sides of the tuber;

wherein the tuber is spaced from the two retaining portions at two sides of the tuber, a pair of tabs defined at a free end of the tuber;

wherein the tuber and the tabs are configured with a T-shaped manner;

wherein the base portion and the connecting portion resist on a second inner face, opposite to the first inner face of the receiving passageway;

wherein the second inner face of the receiving passageway protrude a pair of bosses to form a T-shaped groove to receive the base portion and the connecting portion.

4. The electrical connector as claimed in claim 3, wherein the retaining portions are located adjacent to the mating face.

5. The electrical connector as claimed in claim 3, wherein the groove is disposed at a first inner face while the soldering leg extends along a second inner face opposite to the first inner face.

6. The electrical connector as claimed in claim 3, wherein the free ends scrape the first inner face when the contact is assembled into the receiving passageway.

7. An electrical connector comprising:

an insulative housing defining opposite first and second surfaces and a plurality of passageways extending through the housing and communicating with an exterior through said first and second surfaces, each of said passageways surrounded by a pair of opposite first and second walls and another pair of opposite third and fourth walls;

a T-shaped cross-sectional structure unitarily formed on the first wall and extending along a direction defined from the first to surfaces under condition that said T-shaped cross-sectional structure includes a horizontal bar parallel the first wall, and a vertical bar perpendicularly connected to the first wall;

a plurality of contacts disposed in the corresponding passageways, respectively, each of said contacts defining a U-shaped retention portion proximate the first surface and including opposite retention sections abutting against the third and fourth walls, and a bight linked between said pair of opposite retention sections and abutting against the second wall, a pair of resilient contacting beams respectively extending from the corresponding retention sections in said direction, a connection portion extending from the bight in said direction, and a soldering portion extending from the connection portion and exposed outside of the housing, wherein two ends of said horizontal bar essentially abut against the corresponding opposite retention sections, respectively, in a direction defined between said third and fourth walls;

wherein the second surface protrude a pair of bosses to form a T-shaped groove.

8. The electrical connector as claimed in claim 7, wherein said soldering portion extends perpendicular to the connection portion.

9. The electrical connector as claimed in claim 7, wherein a pair of receiving grooves are formed by two sides of the vertical bar, and each of said receiving grooves is surrounded by the horizontal bar, the vertical bar, the bight and the corresponding retention section so as to receive scraped material of the housing during assembling the contact into the passageway.

* * * * *